United States Patent [19]

Nelson, Jr. et al.

[11] Patent Number: 4,673,411

[45] Date of Patent: Jun. 16, 1987

[54] ANTI-GEL FUEL COMPOSITION

[75] Inventors: Otis L. Nelson, Jr.; Mark L. Nelson, both of Bay City, Mich.

[73] Assignee: Polar Molecular Corporation, Saginaw, Mich.

[21] Appl. No.: 901,015

[22] Filed: Aug. 28, 1986

Related U.S. Application Data

[63] Continuation of Ser. No. 569,441, Jan. 9, 1984, abandoned.

[51] Int. Cl.[4] ..... C10L 1/02

[52] U.S. Cl. ..... 44/53; 44/54; 44/57; 44/62; 44/77; 252/55; 252/351

[58] Field of Search ..... 44/53, 51, 54, 57, 62, 44/77; 252/55, 351; 585/14

[56] References Cited

U.S. PATENT DOCUMENTS

| | | | |
|---|---|---|---|
| 2,672,450 | 3/1954 | Pearsall | 44/58 |
| 2,914,479 | 11/1959 | Tom et al. | 44/77 |
| 3,250,599 | 5/1966 | Kirk et al. | 585/14 |
| 3,658,494 | 4/1972 | Dorer, Jr. | 44/77 |
| 3,917,537 | 11/1975 | Elsdon | 44/53 |
| 4,365,973 | 12/1982 | Irish | 44/57 |
| 4,378,973 | 4/1983 | Sweeney | 44/57 |

OTHER PUBLICATIONS

The Condensed Chemical Dictionary, 9th Ed., Revised by Gessner H. Hawley, Van Nostrand Reihold Co.; N.Y., N.Y., 1977, p. 30.

*Primary Examiner*—William R. Dixon, Jr.
*Assistant Examiner*—Margaret B. Medley
*Attorney, Agent, or Firm*—Lackenbach Siegel Marzullo & Aronson

[57] ABSTRACT

An antigel fuel additive contains a polar long chain oxygenated hydrocarbon having a high molecular weight and having an acid number of 25 to 125, and preferably 50 to 100. The oxygenated hydrocarbon is combined with a hydrophillic precipitant such as a glycol ether, and hexanol, and a low molecular weight polyethylene-vinyl acetate copolymer. The additive need only be added in about 0.3 to 1 part per thousand parts of the particular fuel, to prevent the formation of wax particulates at low temperatures. Diesel and no. 2 heating oil fuels are contemplated uses.

19 Claims, No Drawings

ANTI-GEL FUEL COMPOSITION

This application is a continuation application of Ser. No. 569,441 filed Jan. 9, 1984 now abandoned.

FIELD OF THE INVENTION

This invention relates to anti-gel additives for fuels such as diesel fuel and no. 2 heating fuel.

BACKGROUND AND DISCUSSION OF THE PRIOR ART

Heretofore it was known to add certain oxygenated hydrocarbons to gasoline and diesel fuels to improve performance of the fuels. These oxygenated hydrocarbons had acid numbers of about 10 and saponification numbers of about 26. While such attempts proved moderately successful, the level of improvement was not that which was desired.

It was also known in the aviation fuel art to add small amounts of certain glycol ethers to the fuels to prevent icing.

A particular problem with regard to diesel fuels and more particularly heating oils is that at low temperatures, wax particulates would form tending to clog fuel filters and spray nozzles.

It is a principal object of the present invention to provide an additive for diesel fuels and no. 2 heating fuels which reduces the agglomeration of and disperses wax particulates which would tend to form at low operating temperatures.

It is another principal object of the present invention to provide an composition for heating and diesel fuels which improves lubricity and fuel consumption.

It is still a further object of the present invention to provide an composition as aforesaid in which only limited quantities of the composition need be added to render the additive fully effective.

SUMMARY OF THE INVENTION

An additive for heating and diesel fuels contains substantial quantities of a highly polar, high molecular weight oxygenated hydrocarbon. The oxygenated hydrocarbon has a molecular weight of 250–500 and an acid number of 25 to 125 (ASTM-D-974), and, most important and most preferrably, 50 to 100. A hydrophilic precipitant such as a glycol ester is provided in combination with the oxygenated hydrocarbon, as well as a compatibility agent, such as hexanol. In the diesel fuel or no. 2 heating oil fuel additive application, the further addition of a low molecular weight copolymer in combination with the aforesaid reduces wax particulate agglomeration.

DESCRIPTION OF THE PREFERRED EMBODIMENTS

In a broad sense, the present invention is the use of a polar, high molecular weight, oxygenated hydrocarbon water dispersant, hydrophilic precipitants, a low molecular weight copolymer to reduce the agglomerates of and promote dispersion of wax particulates at low operating temperatures.

The general formulations of the additive compositions particularly useful for diesel and no. 2 heating fuels are shown in the following Table I:

TABLE I

| Component | Weight percent (Wt. %) Preferred Range | Useful Range |
|---|---|---|
| Hexanol | 10–20 | 5–30 |
| Glycol ether | 10–30 | 5–50 |
| Oxygenated hydrocarbons | 30–50 | 10–70 |
| Low molecular weight copolymer | 30–50 | 5–60 |

Suitable oxygenated hydrocarbons useful in the present invention include heavy oils which have been oxygenated at elevated temperatures to render them highly polar. The molecular weight of the oxygenated hydrocarbon should be from 250 to 500. A particularly preferred oxygenated hydrocarbon is one having an acid number between 25 and 125 (ASTM-D-974), and most importantly and preferrably between 50 and 100, and a saponification number of 30 to 250, and preferrably 75 to 200 (ASTM-D-974-52). "A most preferred oxygenated hydrocarbon is Alox 400 L (Alox Corporation, Niagara Falls, N.Y.".

Suitable hydrophilic precipitants useful in the present invention include the glycol alkyl ethers particularly diethylene glycol methyl ether, ethylene glycol ethyl ether, tri-ethylene glycol methyl ether, and the like. Dimethylene glycol methyl ether is most preferred.

It was surprisingly found that hexanol served as an excellent compatibilizing agent for the oxygenated hydrocarbons and hydrophilic precipitants. While mixed hexanol isomers may be employed, normal hexanol is preferred.

Suitable low molecular weight copolymers are polyethylene-vinyl acetate copolymers with a molecular weight of less than 2,000. Preferred copolymers are Allied AC-430 (Allied Corporation, Morristown, N.J.) and Exxon ECA-7305 (Exxon Corporation, Linden, N.J.).

The diesel and no. 2 heating oil additive is fully effective in no more than about 1 part by weight of additive to 1,000 to 3,000 parts by weight of fuel.

Without wishing to be bound by any theory or mechanism, it is believed that the highly effective improved lubricity and fuel combustion results from the orientation of the long chain polar oxygenated hydrocarbon so that the polar end of the molecule is oriented towards the metal wall surface of the engine while the non-polar hydrocarbon is directed away from the metal wall surface. In this manner, a monomolecular lubricating film is provided and water molecules are dispersed away from the metal surface. The complementing addition of glycol esters, hexanol and low molecular weight polyethylene-vinyl acetate copolymers to the fuel provides a balanced combination which avoids wax particulates at low temperatures, while providing improved lubricity.

The following example is illustrative of the invention:

EXAMPLE I

| Diesel Additive | |
|---|---|
| Component | Weight Percent |
| hexanol[1] | 10 |
| diethylene glycol methyl ether | 10 |
| oxygenated hydrocarbon | 40 |
| polyethylene-vinyl acetate | 40 |

-continued

| Diesel Additive | |
|---|---|
| Component | Weight Percent |
| copolymer[3] | |

[1]EPAL-6 (Ethyl Corp., Baton Rouge, La.)
[2]ECA 730 (Exxon Corp., Linden, N.J.)

Hexanol and glycol ether are mixed at room temperature and agitated for 5 minutes. Then the copolymer is added and agitation continued for about 15 minutes at 60°-70° F. Finally the oxygenated hydrocarbon is added and agitation continued for 10 to 15 minutes.

A five gallon can of no. 2 distillate diesel fuel (summergrade) containing 1 part of the aforesaid composition to 3,000 parts of the diesel fuel was installed in a freezer with a temperature controller. The additive must be blended with the fuel at a temperature of at least 10° F. above the fuel cloud point. A dip pipe was mounted in the five gallon container and extended through the freezer compartment wall into the suction of a Detroit Diesel Truck Pump run by a 100 V, 1725 RPM motor to simulate 1750 RPM speed. A 0-100 psi pressure gauge was installed in the discharge line of the pump with a back pressure control valve to simulate the 50 to 70 psi back pressure that is designed into the return line of a Detroit Diesel fuel system. The temperature of the freezer was gradually reduced to −17° F. After 17 hours, the motor was energized, and five gallons of fuel at −17° F. were pumped out without plugging the 10 micron fuel filter with wax crystals. The filter was carefully inspected in this regard.

The same test when run without the addition of the additive composition caused wax plugging of the filter at −1° F.

The additive of Example I is useful in all middle distillates including, by way of example, no. 2 heating oil or diesel fuel. When added in amounts of 1:1,000-3,000, the additive (1) reduces wax build-up at low temperatures, (2) inhibits corrosion, (3) provides upper cylinder lubrication so as to increase engine efficiency and increase engine life, (4) protects the stored dormant fuel from deterioration through oxidation particularly where metal parts are present, (5) reduces microbial growth, (6) inhibits icing, and (7) provides engine surface cleaning.

While particular embodiments of the invention have been described, it is understood that the invention is not to be so limited, but is to be defined by the scope of the appended claims.

What is claimed is:

1. An antigel composition comprising
(a) 10-70 wgt % of a polar, oxygenated, long chain hydrocarbon having an acid number from about 25 to about 125;
(b) 5-50 wgt % of a glycol ether hydrophilic precipitant;
(c) 5-60 wgt % of a low molecular weight addition copolymer; and
(d) 5-30 wgt % of an alcoholic compatibilizing agent;
whereby the composition prevents wax plugging of a 10-micron fuel filter at about −17° F.

2. The composition of claim 1, wherein the oxygenated hydrocarbon has an acid number from about 50 to about 100.

3. The composition of claim 1, wherein the oxygenated hydrocarbon has a molecular weight of about 250 to about 500 and a saponification number of about 30 to 250.

4. The composition of claim 1, wherein the alcoholic compatibilizing agent is a hexanol.

5. The composition of claim 1, wherein the glycol ether is diethylene glycol methyl ether.

6. The composition of claim 1, wherein the wgt % proportions are:
oxygenated hydrocarbon 30-50
low molecular wgt copolymer 30-50
alcoholic compatibilizer 10-20
hydrophilic precipitant 10-30.

7. The composition of claim 6, wherein the low molecular weight copolymer has a molecular weight less than 2,000.

8. The composition of claim 7, wherein the copolymer is one of ethylene and vinyl acetate.

9. The composition of claim 1, wherein the copolymer is one of ethylene and vinyl acetate.

10. The composition of claim 1, wherein the oxygenated hydrocarbon has an acid number of 50 to 100 and a saponification number of 75-200, the hydrophilic precipitant is a glycol ether, the addition copolymer is ethylene-vinyl acetate, and the alcoholic compatibilizer is a hexanol.

11. The composition of claim 10, wherein the contents by weight percent are approximately:
oxygenated hydrocarbon 40
glycol ether 10
copolymer 40
hexanol 10

12. The composition of claim 11, wherein the glycol ether is diethylene glycol methyl ether.

13. In combination;
(a) a fuel comprising diesel or No. 2 heating fuel; and
(b) an antigel composition comprising,
(i) a polar oxygenated hydrocarbon having an acid number from about 25 to about 125;
(ii) a glycol ether precipitant,
(iii) a low molecular wgt addition copolymer, and
(iv) an alcoholic compatibilzer,
whereby when the antigel composition is present in an effective amount of about 1 part antigel to 1,000-3,000 parts fuel, wax plugging of a 10-micron fuel filter is avoided at about −17° F.

14. The combination of claim 13, wherein the alcoholic compatibilizer comprises hexanol.

15. An antigel composition consisting essentially of:
(a) a polar oxygenated hydrocarbon having an acid number from about 25 to about 125, a saponification number from about 30 to about 250, and a molecular weight from about 250 to about 500;
(b) a glycol ether hydrophilic precipitant;
(c) an alcoholic compatibilizing agent; and
(d) an addition copolymer having a molecular weight less than about 2000.

16. The antigel composition of claim 15, wherein the alcoholic compatibilizer is a hexanol.

17. The antigel composition of claim 16, wherein the addition copolymer is one of ethylene and vinyl acetate.

18. The antigel composition of claim 15, wherein the glycol ether is diethylene glycol methyl ether.

19. In combination;
(a) a fuel comprising diesel or No. 2 heating fuel;
(b) an antigel composition consisting essentially of
(i) polar oxygenated hydrocarbon having an acid number from about 25 to about 125; a saponification number from about 30 to about 250, and a molecular weight from about 250 to about 500;

(ii) diethylene glycol methyl ether;

(iii) an alcoholic compatibilizing agent; and (iv) a low molecular weight copolymer of ethylene and vinyl acetate;

whereby when the antigel compositiion is present in an effective amount of about 1 part antigel to about 1000–3000 parts fuel, wax plugging of a 10-micron fuel filter is avoided at about −17° F.

* * * * *